United States Patent [19]

Grunst et al.

[11] Patent Number: 4,578,549

[45] Date of Patent: Mar. 25, 1986

[54] SNAP ACTION ELECTRICAL SWITCH

[75] Inventors: Heinz Grunst; Heinz Kleine, both of Marienheide, Fed. Rep. of Germany

[73] Assignee: Square D Starkstrom GmbH, Marienheide, Fed. Rep. of Germany

[21] Appl. No.: 645,845

[22] Filed: Aug. 29, 1984

[30] Foreign Application Priority Data

Sep. 8, 1983 [EP] European Pat. Off. ..... 83 108849.7

[51] Int. Cl.[4] ..... H01H 15/18

[52] U.S. Cl. ..... 200/76

[58] Field of Search ..... 200/76

[56] References Cited

U.S. PATENT DOCUMENTS 3,973,094 8/1976 Kuhn ..... 200/76

4,477,703 10/1984 Reguant Soler ..... 200/76

*Primary Examiner*—Stephen Marcus

*Assistant Examiner*—Renee S. Kidorf

*Attorney, Agent, or Firm*—Michael J. Striker

[57] ABSTRACT

In a switching device for an end snap-action switch which includes a support, a displaceable actuating push rod and contact bridges two double-armed pivotable levers are connected to the support to move the contact bridges in two opposite directions within a housing.

21 Claims, 9 Drawing Figures

SNAP ACTION ELECTRICAL SWITCH

BACKGROUND OF THE INVENTION

The present invention pertains to a switch device, particularly for an end switch or a limiting key.

Switching devices of the type under discussion include a spring control mechanism and at least one contact bridge guided and displaceable in a contact bridge support and actuated by means of an actuating push rod.

Switching devices of the foregoing type and of various constructions have been known in practice. These switches have in common that for carrying out a switching process to actuate one or more contact bridges a push rod is utilized, which acts on the spring control mechanism which can jump over from one end or rest position to another end or rest position when an intermediary dead point of the spring mechanism, upon the displacement of the push rod, is passed. The switching movement of the contact bridge upon the release of the push rod always takes place in the direction counter to the direction of the displacement of the push rod. Since the displacement ratio or the displacement process, that takes place within the enclosed housing, can not be detected from outside of the switching device an error can be easily made by a user as in which direction the push rod is to be actuated to actuate a contact opening member or bridge or a contact closing member or bridge.

SUMMARY OF THE INVENTION

It is an object of the present invention to provide an improved switching device.

It is another object of the present invention to provide a switch which is easy to use.

It is still a further object of the present invention to provide a switching device in which the direction of movement of the displaceable components would coincide with the direction of the actuation of the push rod and in which a force-locking connection between the push rod and the support for supporting the contact bridges would be provided.

These and other objects of the invention are attained by a switching device, particularly for end switches or limiting keys, comprising a housing; a spring control mechanism; a support; at least one contact bridge movably guided in said support; stationary contacts; said mechanism, said support, said contact bridge and said stationary contacts being accommodated in said housing; an actuating push rod connected to said spring control mechanism and actuated and displaced from outside of said housing so as to displace said contact bridge through said spring control mechanism and said support toward and away from said stationary contacts, said spring control mechanism including means displacing said contact bridge during the switching such that the direction of the displacement of said contact bridge corresponds to the direction of the displacement of said push rod.

Two contact bridges may be provided on said support.

Said means may include two double-armed levers positioned in said housing and being operative for reversing the direction of displacement of said spring control mechanism, said two levers cooperating with said support.

The device may further include a slide extended in said housing and rigidly connected to said push rod to be displaced thereby, and a guide member for guiding said slide during its displacement.

The spring control mechanism may include two elastic spring means interengaged between said slide and said guide member.

Each lever may have one arm engaged with said guide member and another arm engaged in said support.

The housing may be formed with stationary bearings, said double-armed levers carrying pins pivotally supported in said bearings to enable a pivoting motion of each lever.

The slide may have an inner end opposite to said push rod; and the device including a compression spring, said housing having an inner wall, said compression spring having one end supported against said housing wall and another end supported against said inner end.

A first abutment may be provided on said inner wall and a second abutment may be formed on said inner end, said compression spring being supported between said first and second abutment.

The guide member may be a rectangular hollow frame and include two lateral portions spaced from each other said frame surrounding said slide such that said two elastic spring means are each positioned between said slide and a respective lateral portion of said frame.

Each of the spring means may include two notches, said slide being formed with projections each engaging in one notch of each spring means, each lateral portion of said frame having a projection engaged in another notch of each spring means.

One arm of each lever may be formed with a guiding slot, said frame carrying on each lateral portion thereof a pin which is engaged in the guiding slot of said one arm of each lever.

Another arm of each lever may be provided with an additional pin, said support being formed with guiding slots each engaging the additional pin of the respective lever.

The housing has a bottom which may be formed with a guiding recess which limits a path of the displacement of said guide member.

The housing has side walls which may be formed with guiding recesses which accommodate said levers, respectively.

The support may be formed as a double-cross member and include two opposite lateral arms, an intermediate web extended therebetween and four parallel arms arranged in pairs and extended normal to said lateral arms and in the direction of the displacement of the support, actuated by said push rod and said spring control mechanism.

The parallel arms may have recesses, in each of which the respective one contact bridge may be movably guided.

The device may further include contact compression springs each positioned between two parallel arms of each pair, each contact compression spring being supported at one end thereof against the respective contact bridge and at another end thereof against said intermediate web of said support.

The parallel arms may be each formed with projections extended downwardly from the ends thereof, said slide being guided in the direction of displacement by said projections.

The push rod may have a pusher arm, said pusher arm having such a length to ensure that, upon pushing said actuating push rod inward of said housing, eventually welded or held together opening contacts between the contacts of said contact bridge and said stationary contacts become forcefully broken up.

Each spring means may include two members displaceable one within another and a helical spring surrounding said two members.

Each of said spring means may alternatively include a cylindrical element formed of elastic plastics and a helical spring inserted in said cylindrical element.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
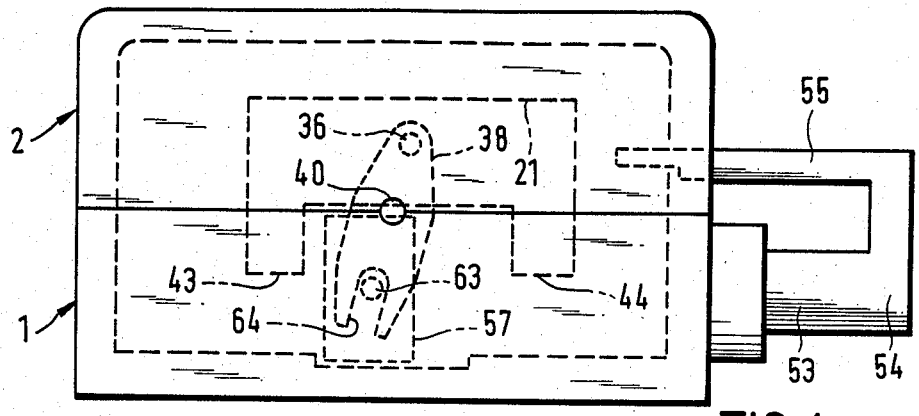
FIG. 1 is a side view of the switching mechanism according to the invention.
Figure 2:
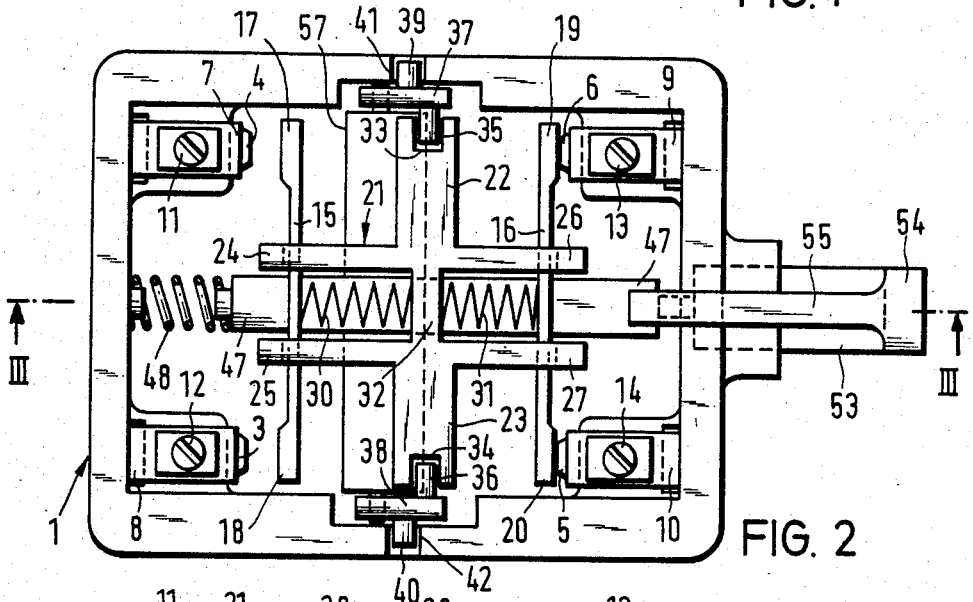
FIG. 2 is a top plan view of the switching mechanism with the upper housing portion or cover removed.

In the embodiment illustrated in FIGS. 1 through 8 the housing of the switch device of this invention includes a lower housing portion 1 and an upper housing portion or lid 2. Referring first to FIGS. 1 and 2 it will be seen that stationary contact members 3, 4, 5 and 6 are positioned within the housing. These contact members are arranged on stationary contact bars 7, 8, 9 and 10, respectively, which are provided with contact connecting screws 11, 12, 13 and 14 to which electrical connections or wiring for the switch device are applied. The contact connecting screws 12–14 are arranged in the exemplified embodiment within the housing. It is understandable, however, that through openings at suitable locations in the housing for the insertion of wires or cables can be made. The stationary contact bars can also extend outwardly of the housing 1, 2 so that the contact connecting screws would be readily accessible and the wiring would be then connected to them without the removal of the upper portion 2 of the housing.

Movable contact elements 17, 18, 19 and 20, which are fastened to two contact bridges 15, 16, respectively cooperate with corresponding stationary contact members. In the exemplified embodiment contact bridge 15 forms a closing contact member and contact bridge 16 forms an opening contact member. Both contact bridges 15 and 16 are movably supported and guided in a common contact bridge holder or support 21. The latter is formed as a double cross and includes two lateral arms 22 and 23 and four arms 24, 25, 26 and 27 arranged in pairs and extended normally to the lateral arms 22 and 23 in the direction of displacement.

Figure 3:
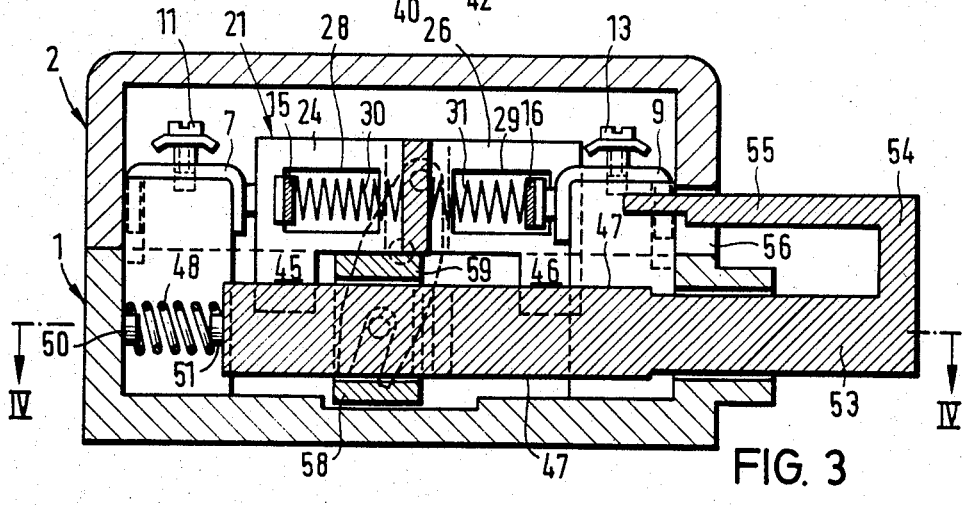
FIG. 3 is a sectional view taken along line III—III of FIG. 2.

With reference to FIGS. 2 and 3, it is seen that contact bridges 15 and 16 are movably guided in recesses 28, 29 formed in arms 24 through 27. Contact bridges 15, 16 are under pressure of respective contact compression springs 30 and 31, which are inserted between arm pairs 24, 25 and 26, 27. Compression springs 30 and 31 are each supported at one end against the wall of the contact bridge 15, 16 and, at another end, against an intermediate web 32 of the support 21.

The ends of arms 22 and 23 are formed with vertical guidance slots 33 and 34 in which pins 35 and 36, formed on and extended outwardly of respective levers 37 and 38, are engaged. Pins 35 and 36 are each provided on the upper, end of the respective lever 37, 38. Lever 38, with pin 36, is shown in dotted line in FIG. 1. Each lever 37, 38 is a double-armed lever. Each double-armed lever 37, 38 is pivotally supported in a stationary bearing 41, 42 formed by a respective recess or bore provided in the housing portions 1, 2. To enable the pivoting motion of each double-armed lever each lever is provided with a pin 39, 40, pins 39, 40 extending outwardly from the outer sides of the respective levers, or in the directions opposite to the directions of the extensions of pins 35 and 36. The fact that bearings 41, 42 are formed by the bores in the housing facilitates the assembly of the switch device. It is, of course, understandable that bearings 41, 42 could be formed in any other suitable manner.

Figure 5:
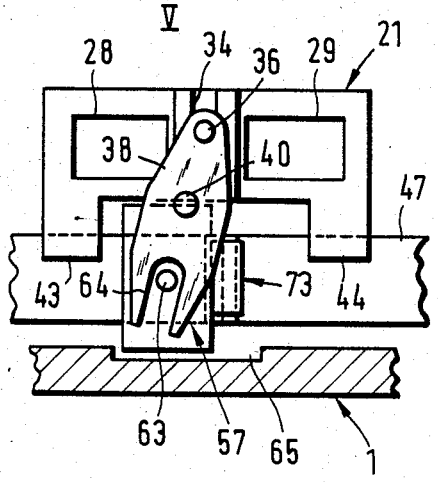
FIG. 5 is an enlarged detail illustrating the switching unit in a switch-off position.
Figure 6:
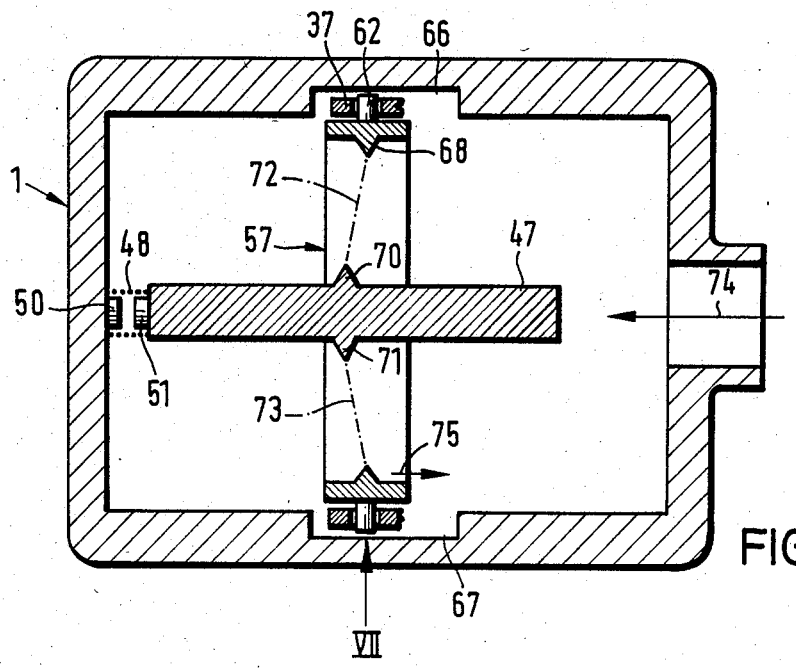
FIG. 6 is a view similar to that of FIG. 4 but in a switching position of the mechanism.
Figure 7:
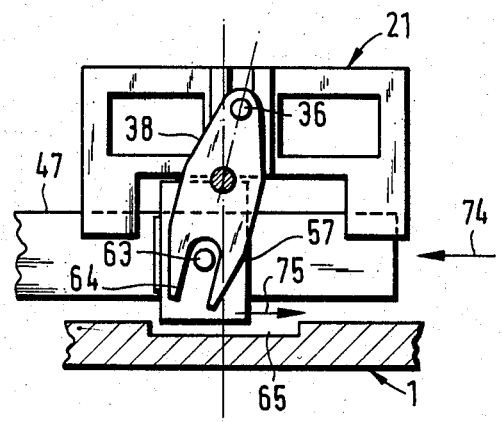
FIG. 7 is a view similar to that of FIG. 5 but in the switch-on position.

With reference to FIGS. 3 and 5, one can see that the contact bridge support 21 has on each of its arms 24, 25, 26 and 27 projections 43, 44, 45 and 46 which extend toward a slide 47 and serve to provide a guidance between the support 21 and slide 47 in the direction of displacement.

Figure 4:
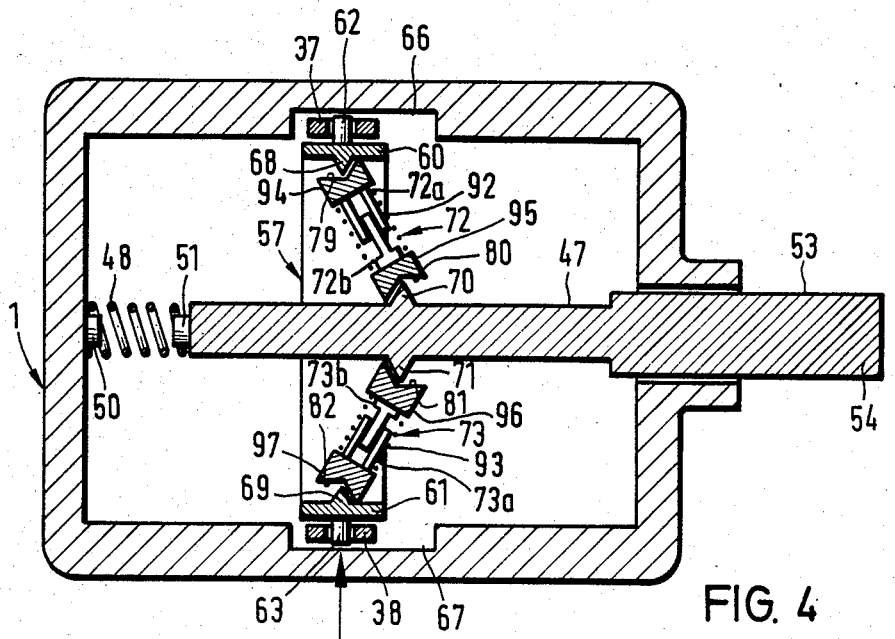
FIG. 4 is a sectional view taken along line IV—IV of FIG. 3.

As seen in FIGS. 3 and 4, slide 47 carries at the outer end thereof an actuating push rod 53 which is displaceable by an operator inwardly and outwardly of the housing 1, 2. A compression spring 48 is arranged between the inner end of slide 47 and the wall of housing portion 1. One end of compression spring 48 is supported at an abutment 50 formed at the housing portion 1 while its outer end is supported at the abutment 51, provided on the end wall of slide 47.

Actuating push rod 53 carries a pusher arm 55 which is formed advantageously as one piece with the push rod. Pusher arm 55 extends inwardly of the housing 1, 2 through an opening 56. The length of pusher arm 55 is so selected that, upon a pushing of the actuating push rod 53 inward of the housing of the switch, eventually welded or glued opening contacts between the contact elements 19, 20 of contact bridge 16 and stationary contact members 5, 6 are forcefully broken up; in other words, when the actuating push rod 53 together with pusher arm 55, as shown in FIGS. 2 and 3, is pushed to the left the end face of the pusher arm comes into contact with the middle portion of the contact bridge 16 and forcefully carries the latter over if the contacts of this opening contact member have not shortly before opened. It is advantageous that the pusher arm 55 is a portion of an angular piece 54 which is integral with and merges from the end of push rod 53.

As mentioned above, the actuation of push rod 53 effects the movement of slide 47. Slide 47 is guided in a guide member 57 which is formed as a rectangular frame and includes a lower portion 58, and upper portion 59 and two side portions 60 and 61 as specifically clearly shown in FIG. 4. Guide member or frame 57 surrounds slide 47 but is sufficiently wide to form between the inner walls of side portions 60 and 61 and the side walls of slide 47 spaces in which elastic spring units 72 and 73 are accommodated. Each spring unit 72, 73 is advantageously supported on the one hand by projections 68, 69 and 70, 71, formed on the lateral portions 60, 61 and on the opposite walls of slide 47, respectively, and on the other hand, by notches 79, 80, 81 and 82 formed on the supporting elements of each spring unit and engaging with the respective projections.

Pins 62 and 63 are formed on the lateral portions 60, 61 of the guide frame 57, pins 62, 63 extending outwardly from the outer walls of lateral portions 60, 61 respectively. These pins can be either formed integral with the guide frame or be rigidly connected to the lateral portions thereof by any suitable conventional means. Each pin 62, 63 can be engaged in the lower arm of the respective double armed lever 37, 38, namely in a guiding recess 64 formed in the fork-shaped lower arm of each double armed lever.

As can be seen in FIG. 5 the displacement path of guide frame 57 is limited by a guiding recess 65 formed in the bottom of the lower housing portion 1. Furthermore, levers are accommodated in guiding recesses 66 and 67 provided in the side walls of the housing portions 1 and 2.

Each spring unit 72, 73 includes two elements **72*b*, 72*a* or 73*b*, 73*a*, one guided and displaceable within another and surrounded by helical springs 92, 93 supported between the opposite supporting members 94, 95 or 96, 97 formed respectively with the above mentioned notches at the outer surfaces thereof as can be clearly seen in FIG. 4**.

Figure 8:
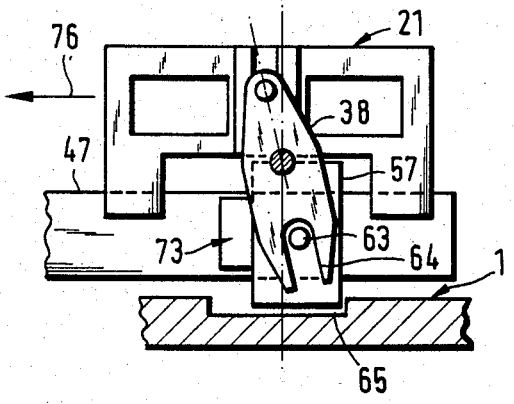
FIG. 8 is a view corresponding to that of FIG. 7 but in the other switch-on position.

The mode of operation of the switch device illustrated in FIGS. 1 through 8 is as follows:

When the actuating push rod 53 is actuated and displaced from a rest position shown in FIGS. 1 to 5 in the direction of arrow 74 (FIGS. 6, 7) or leftwardly slide 47 is carried with push rod 53 under the compression action of compression spring 48. At the same time, spring units 72, 73, which in FIG. 4 corresponding to the right-hand remote position of actuating push rod 53 take an inclined position, will be compressed because the guide frame 57 has taken the left-hand end or stop position. This condition remains unless the spring units 72 and 73 come to a middle position and become positioned along a straight line relative to each other. As soon as this dead point has been overcome, that is the slide 47 is further displaced in the leftward direction, spring units 72 and 73 will again take an inclined or oblique position as indicated by dash-dotted lines in FIG. 6. From this moment will spring units 72 and 73 again stretch and will actuate in an impact-like fashion the displacement of guide frame 57 in the direction of arrow 75 (FIG. 7 in the right-hand directioh unless guide frame 57 will take another end or stop position in the guide recess 65 of housing portion 1 as shown in FIG. 8. Thereby both levers 37 and 38 are pivoted and actuate an impact-like displacement of support 21 in the direction of arrow 76 (FIG. 8). Inasmuch as contact bridges 15 and 16 are taken along with the contact bridge support 21 a switching process results. Therefore the direction of the movement of the contact bridges 15, 16 and that of the support 21 correspond to the direction of the displacement of actuating push rod 53. The reverse of the direction of the displacement of the above described spring control mechanism is performed also by both double armed levers 37 and 38. Upon a release of the actuating push rod 53 the operation of the above described elements of the switch is executed in a reverse sequence.

Figure 9:
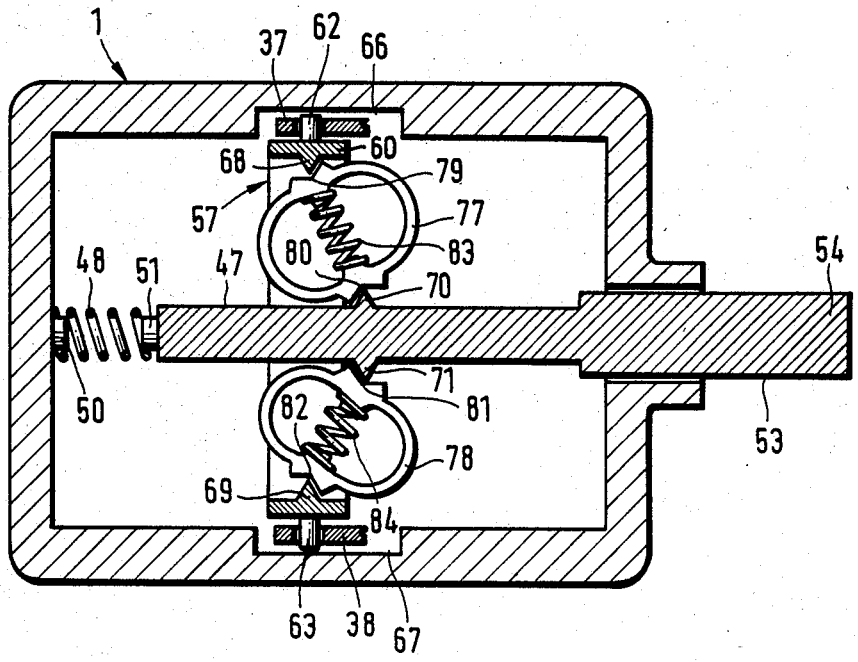
FIG. 9 is the view corresponding to that of FIG. 4 but of the modified embodiment of the invention.

FIG. 9 illustrates another embodiment of the invention. All the component parts of the modified construction of FIG. 9 are identical to those of FIGS. 1–8 with the exception of the construction of the elastic spring units which are here designated by reference numerals 77 and 78. Spring units 77 and 78 are substantially cylindrical pieces made out of flexible, elastic synthetic plastic material. This embodiment is simplified and the insertion of spring units 77, 78 is facilitated, which is important because in actual practice the size of the switch device can be smaller than that shown in the drawings. Each spring unit 77, 78 may include a compression spring 83, 84 accommodated within the cylindrical piece made of plastics. Each cylindrical piece of the respective spring unit is formed with two oppositely positioned notches 79, 80 or 81, 82, which engage with the respective projections on the slide 47 and guide frame 57 as explained hereinabove. In order to obtain an increase in the spring action and to avoid eventual fatigue of the elastic plastics of the cylindrical pieces the compression springs 83 and 87 can be inserted into the cylindrical pieces of units 77, 78. It is to be understood that springs 83, 84 can be assembled with the cylindrical pieces surrounding them outside the switch device as individual units and may be then inserted into the housing 1, 2 of the switch device.

It will be understood that each of the elements described above, or two or more together, may also find a useful application in other types of switching devices differing from the types described above.

While the invention has been illustrated and described as embodied in a switching device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A snap-action switch, particularly for end switches or limiting keys, comprising a housing; a support; two contact bridges carrying contacts and being movably guided in said support; stationary contacts; means for displacing said support and said contact bridges; said displacing means, said support, said contact bridges and said stationary contacts being accommodated in said housing; an actuating push rod; and spring-elastic means interconnected between said push rod and said displacing means, said push rod being connected to said spring-elastic means and actuated and displaced from outside of said housing in two opposite directions so as to displace said contact bridges by said spring-elastic means, said displacing means and said support toward and away from said stationary contacts, said displacing means displacing said contact bridges during the switching such that the direction of the displacement of said contact bridges corresponds to the direction of the displacement of said push rod; said displacing means including two double-armed levers positioned in said housing and cooperating with said support for reversing the direction of displacement of said contact bridges.

2. The switch as defined in claim 1, said displacing means further including a slide extended in said housing and rigidly connected to said push rod to be displaced thereby, and a guide member guiding said slide during its displacement.

3. The switch as defined in claim 2, wherein said push rod has a pusher arm, said pusher arm having such a length to ensure that, upon pushing said actuating push rod inward of said housing, eventually welded or held together opening contacts between the contacts of the respective contact bridge and said stationary contacts become forcefully broken up.

4. The switch as defined in claim 3, wherein said pusher arm is an angular portion of said push rod.

5. The switch as defined in claim 2, wherein said spring-elastic means includes two elastic spring units interengaged between said slide and said guide member so that, upon the displacement of said slide by said push rod, said spring units cause a displacement of said guide member.

6. The switch as defined in claim 5, wherein each lever has one arm engaged with said guide member and another arm engaged in said support.

7. The switch as defined in claim 5, wherein said housing is formed with stationary bearings, said double-armed levers carrying pins pivotally supported in said bearings to enable a pivoting motion of each lever.

8. The switch as defined in claim 7, wherein said slide has an inner end opposite to said push rod, and further including a compression spring, said housing having an inner wall, said compression spring having one end supported against said housing wall and another end supported against said inner end.

9. The switch as defined in claim 8, wherein a first abutment is provided on said inner wall and a second abutment is formed on said inner end, said compression spring being supported between said first and second abutment.

10. The switch as defined in claim 8, wherein said guide member is a rectangular hollow frame including two lateral portions spaced from each other, said frame surrounding said slide such that said two elastic spring units are each positioned between said slide and a respective lateral portion of said frame.

11. The switch as defined in claim 10. each of said spring means includes two notches, said slide being formed with projections each engaging in one notch of each spring units, each lateral portion of said frame having a projection engaged in another notch of each spring unit.

12. The switch as defined in claim 11, wherein said one arm of each lever is formed with a guiding slot, said frame carrying on each lateral portion thereof a pin which is engaged in the guiding slot of said one arm of each lever.

13. The switch as defined in claim 12, wherein said another arm of each lever is provided with an additional pin, said support being formed with guiding slots each engaging the additional pin of the respective lever.

14. The switch as defined in claim 13, wherein said housing has a bottom formed with a guiding recess which limits a path of the displacement of said guide member.

15. The switch as defined in claim 13, wherein said housing has side walls formed with guiding recesses which accommodate said levers, respectively.

16. The switch as defined in claim 13, wherein said support is formed as a double-cross member and includes two opposite lateral arms, an intermediate web extended therebetween and four parallel arms arranged in pairs and extended normal to said lateral arms and in the direction of the displacement of the support, actuated by said push rod and said spring-elastic means.

17. The switch as defined in claim 16, wherein said parallel arms have recesses in each of which the respective one contact bridge is movably guided.

18. The switch as defined in claim 17, further including contact compression springs each positioned between two parallel arms of each pair, each contact compression spring being supported at one end thereof against the respective contact bridge and at another end thereof against said intermediate web of said support.

19. The switch as defined in claim 18, wherein said parallel arms are each formed with projections extended downwardly from two ends thereof, said slide being guided in the direction of displacement by said projections.

20. The switch as defined in claim 19, wherein each spring unit includes two members displaceable one withing another and a helical spring surrounding said two members.

21. The switch as defined in claim 19, wherein each of said spring unit includes a cylindrical element formed of elastic plastics and a helical spring inserted in said cylindrical element.

* * * * *